US006431099B1

(12) United States Patent
Huang

(10) Patent No.: US 6,431,099 B1
(45) Date of Patent: Aug. 13, 2002

(54) SECTIONED SHIP

(75) Inventor: Bill Wen-Chang Huang, 3-F,No. 1, Alley 3, Lane 542, Tai Lin Road, Sec. 2, Tai Shan, Taipei Hsien (TW)

(73) Assignee: Bill Wen-Chang Huang, Taipei Hsien (TW)

( * ) Notice: Subject to any disclaimer, the term of this patent is extended or adjusted under 35 U.S.C. 154(b) by 0 days.

(21) Appl. No.: 09/698,017

(22) Filed: Oct. 30, 2000

(51) Int. Cl.[7] ..... B63B 3/02
(52) U.S. Cl. ..... 114/77 R
(58) Field of Search ..... 114/77 R, 77 A, 114/248, 249

(56) References Cited

U.S. PATENT DOCUMENTS 3,145,681 A * 8/1964 Nakagawa ..... 114/77 R
3,370,564 A * 2/1968 Archer et al. ..... 114/77 R
4,050,395 A * 9/1977 Anderson ..... 114/77 R

FOREIGN PATENT DOCUMENTS

FR 349647 * 2/1904 ..... 114/77 R

* cited by examiner

*Primary Examiner*—Ed Swinehart
(74) *Attorney, Agent, or Firm*—Burns, Doane, Swecker & Mathis, L.L.P.

(57) ABSTRACT

This invention discloses a novel ship design especially suitable for ocean-going merchant vessels and oil tankers. A ship is rendered into two or more independent ship bodies, and these separate ship bodies are joined together by means of hinge; thus the name sectioned ship. In one embodiment of the invention a sectioned ship comprises a fore ship body and an aft ship body, and, by means of a hinge means located in the middle part, i.e., the adjoining surface of said two ship bodies, the two ship bodies are vertically pivotably joined to form a ship. In another embodiment of the invention, a sectioned ship comprises a fore ship body, an aft ship body, and at least one intermediate ship body, and by means of two hinge means located at the two ends of the intermediate ship body these ship bodies are vertically pivotably connected to form a single body. The hinge means may be formed to be detachably separable with respect to the connected ship bodies, or it may be of a fixed, inseparable structure, said hinge means may also be formed of a box-body structure. In comparison with a conventional vessel of the same dimensions and under the same sailing condition, the sectioned ship can put up with about four times greater the stress and strain due to hogging and sagging, therefore, in shipbuilding, thinner steel plates can be used. And, if compared with a conventional vessel of the same structural strength, the sectioned ship can be made larger, which means ship's hold becomes greater, and less engine power and smaller propeller are needed, consequently resulting in less fuel as well as material cost.

24 Claims, 4 Drawing Sheets

SECTIONED SHIP

BACKGROUND OF THE INVENTION

This invention relates to ship design in general. Particularly, this invention relates to a sectioned ship which comprises at least a fore and an aft ship bodies whereby these ship bodies are connected by horizontal hinge means that permits limited pivoting movement relative to each other in a vertical direction to form a ship vessel.

In each harbor or quay there are specific restrictions on ship's draft and dimensions, depending upon factors such as the local terrain and water's depth. On those vessels that are to avail themselves the passage of the Panama Canal, as a rule, more restrictive measures are imposed, due to the special limits of three sets of locks of the canal. The dimensions of a merchant vessel is obviously related to its shipping cost, in that, generally speaking, the larger the ship's hold, the lower the cost, in terms of either unit weight or unit volume of the ship's load. This is good enough a reason for building larger and larger merchantmen. Now, any respectable merchantman sailing between the east and west coasts of North America takes advantage of the Panama Canal, because, if otherwise, different routes like rounding Cape Horn or wriggling through the Magellan Straits would instantly bring to mind the senseless tedium of a voyage no shorter than 8,000 nautical miles, not to mention the heavily added cost and risk. Thus, such a vessel is for ever subject to the limits of the Panama Canal, or so it seems. Anyhow, to increase ship's hold so as to reduce shipping cost makes large vessels desirable; but the dimensions of a merchant ship must meet the various requirements of the harbors and quays it is to stop by, or those of the canals it is bound to negotiate and pass.

There is another consideration pertinent to this disclosure. A ship sailing at high sea is constantly subject to pitching and rolling, and it is not uncommonly known that pitching affects the ship's structural strength much more than rolling does, because this motion always leads to hogging and/or sagging more or less noticeable. Hogging refers to the longitudinal bending of a ship when its center section is raised while the bow and stern are lowered. This phenomenon arises often at sea when the length and angle of incidence of waves is such that a crest supports the center while bow and stem are over the troughs; or, though rarely nowadays, it may arise when cargo is badly distributed, with the heaviest weights at the extremes. As to sagging, this term refers to the longitudinal bending of a ship as the bow and stern are raised while the center is lowered. Sagging occurs oftener than hogging, and it can be a severe strain on the hull. The phenomenon arises at sea when the length and angle of incidence of waves is such that the crests support the ends of the ship while the center is in a trough, or when heavy cargo is concentrated in the center of the ship's length. In short, hogging and sagging refer to deflection of the hull of a ship, and they can be explained in terms of bending moment, a matter of material mechanics. The term moment is defined as the product of a force and the distance between the force and where moment is to be calculated. At any transverse section of a beam, the algebraic sum of the moments of all the forces to either side of the section is called the bending moment at that location. Gravity and buoyancy are significant factors in the consideration of a ship's stability. And the influence of gravity includes ship's weight itself and ship's load. The larger and especially the longer the ship is, the greater the longitudinal bending moment when the ship is being pitched, and, as a consequence, the greater danger of hogging and sagging. Accordingly, to prevent the enlarged vessel from being actually hogged or sagged at sea and going down with men and mice, the vessel's structural strength must be enforced, and this means the use of thicker steel plate for the hull and stronger materials for other structural members, hence, in the course of nature, increases the vessel's weight, and usually a greater engine or power generator becomes a must.

To evaluate the longitudinal bending moment distribution along a ship's hull one may take the hull for a beam and proceed with the argument of statics as follows. For a ship of overall length L and of total weight (including load) W, the variation of bending moment from bow to stern is graphically represented in FIG. 10(A) by the aforementioned simplification. The maximum bending moment, denoted by M, is proportional to the product of W and L, and it occurs at mid-ship location. This can be expressed by the following equation:

$$M=W\times L/C,$$

in which C is an empirical coefficient and, herein, is regarded to be a constant.

Now suppose the ship of overall length L and weight W is cut in half and becomes two ships of which each being of overall length 1/12 L and weight 1/12 W. Then, let Ms be the symbol of the maximum bending moment found in the small ship and, by the above equation, one arrives at $$M_S=(1/12W\times 1/2L)/C=1/4(W\times L)/C=1/4M;$$

i.e. it is only a quarter of the original maximum bending moment found in the ship of overall length L and weight W, as shown in FIG. 10(B). Albeit a simplification based on a simple theory, this realization, it is believed, serves well to indicate the merit of the present invention. Of course, the point is not to build two small ships, each sufficient unto itself, instead of a large one; for that would involve two sets of power generator, propeller, loading and unloading apparatus, and two groups of crew; moreover, that would be contrary to the aim of the inventor, which is to increase the dimensions of a ship, particularly applicable to an ocean-going merchantman with advantage, without rendering impossible to load and unload in a small harbor or to pass the Panama Canal.

In view of the foregoing discussion, the inventor herein discloses a novel ship design, thereby, it is hopeful, one can enlarge a ship's hold for the sake of economy, without necessitating more power and material costs, nor incurring the danger of breaking up the ship at sea; and still, it will be shown, the embodiments of the invention can adjust themselves with ease to the more restrictive regulations of small harbor and, particularly, the Panama Canal.

SUMMARY OF INVENTION

Accordingly, to be more specific, the principal object of the invention is to provide a novel ship design of sectioned ship, wherein the ship is made up of at least two separate ship bodies, and one ship body is linked to the following one via a huge horizontally installed hinge means, thereby permitting of upward as well as downward angular motion of one ship body relative to another. The bending moment on such a sectioned ship is much smaller than that on a conventional ship of comparable dimensions; and, when the sectionized ship is in the act of plowing the waves, the flexible hinge means can absorb a portion of the force of incident waves, thus further reducing bending moment and the threat of hogging and sagging. Cost on fuel or power in sailing, as well as on material needed in ship-building, is also much reduced.

Another object of the invention is to provide a sectioned ship as disclosed in the foregoing, wherein said horizontal hinge means is so designed that it can be readily attached to, as well as detached from, one or both of the related ship bodies; so that, if need be, such as when approaching a small harbor or a certain quay, the sectioned ship can be taken apart by releasing the horizontal hinge means, and each division can be towed into the harbor or to the quay without much ado.

A further object of the invention is to provide a sectioned ship as disclosed in the foregoing, wherein said horizontal hinge means is an independent component of said sectioned ship, and it can be, within reasonable time, installed to connect one ship body with another.

Still another object of the invention is to provide a sectioned ship as disclosed in the foregoing, wherein said horizontal hinge means is covered up by steel plates from ship's bottom as well as at the sides, so as to shield off water, and so as to reduce streamline disturbance due to the creation of hinge part amidships.

Still a further object of the invention is to provide a sectioned ship as disclosed in the foregoing, wherein a vertical pivoting part, like the combination of two up-side-down L-shaped cranks, is mounted on said sectionized ship, close to either side of the ship, and crossing over a separable interface of one ship body and the related horizontal hinge means, so that, as soon as the horizontal hinge means is disengaged at said interface, the sectioned ship can be horizontally folded round the vertical pivoting part by as wide as 180°, and the ship is thus shortened in its overall length. Such measure may be also of value for the sectioned ship to turn about in a small harbor or, for example, in entering the locks of the Panama Canal.

Other objects and features of the invention, will be better understood from the following description of embodiments thereof and the accompanying drawings.

DETAILED DESCRIPTION OF THE INVENTION

Figure 1:
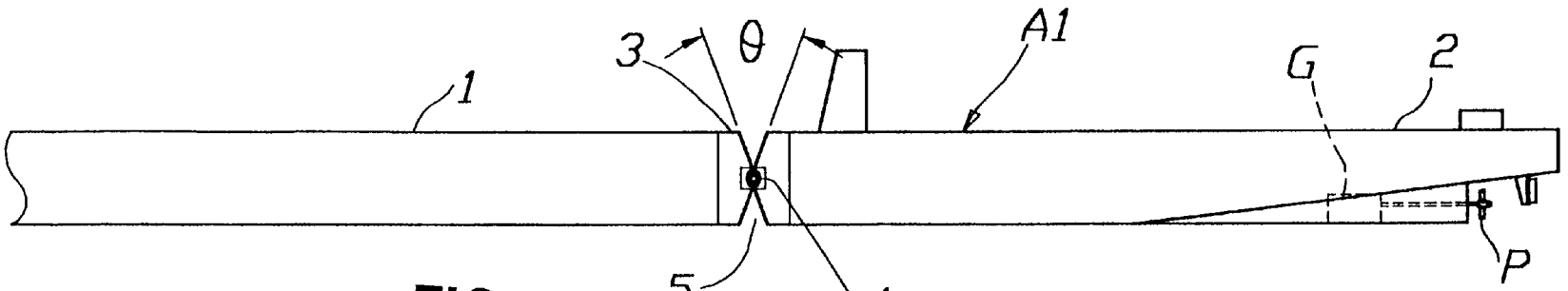
FIG. 1 is a schematic illustration of a basic embodiment of the present invention.

FIG. 1 is a schematic illustration of a basic structure example of a sectioned ship, in which sectioned ship A1 comprises a fore ship body 1 and an aft ship body 2 having on the rear part a screw-propeller P driven by a power generator G, the two ship bodies capable of pivoting up and down with each other by a hinge means 3 located between the two ship bodies 1 and 2 to form by connection into a single body. A huge horizontal pivot shaft 4 of the hinge means is located at the center of said horizontal hinge means 3 and on the upper and lower parts of the pivot shaft 4, there are provided, respectively, with a gap or space 5 permitting the fore and aft ship bodies 1, 2 to perform a pivoting movement of a determined degree θ, for example, a maximum 40°, with each other.

Figure 2:
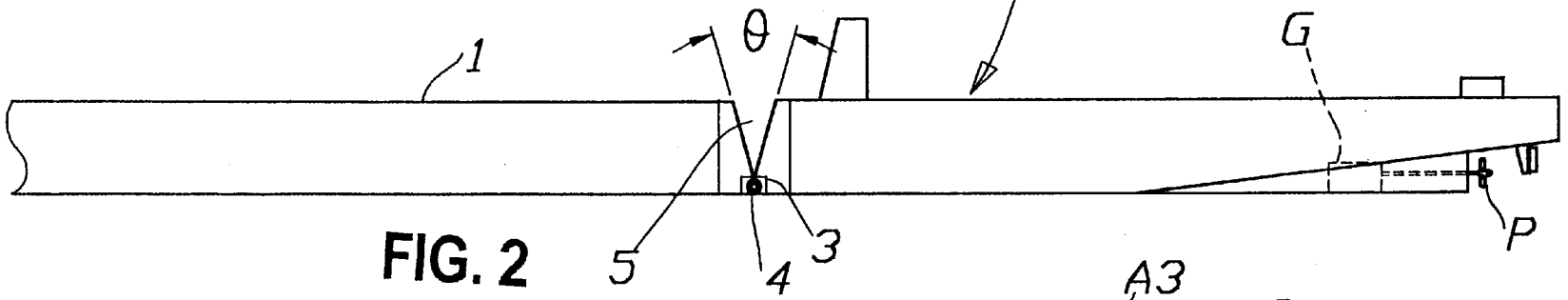
FIG. 2 is a schematic illustration of another embodiment of the sectioned ship of the invention.

FIG. 2 shows schematically another structure example of the sectioned ship of the invention, in which the sectioned ship A2 comprises a fore ship body 1, an aft ship body 2, and a horizontal hinge means 3; this example differs however from the previous one in that the horizontal pivot shaft 4 of hinge means 3 is disposed near the bottom position of the ship and is provided on the upper part with a gap or space 5 for the two ship bodies 1, 2 to perform pivoting movement of a determined degree θ.

Figure 3:
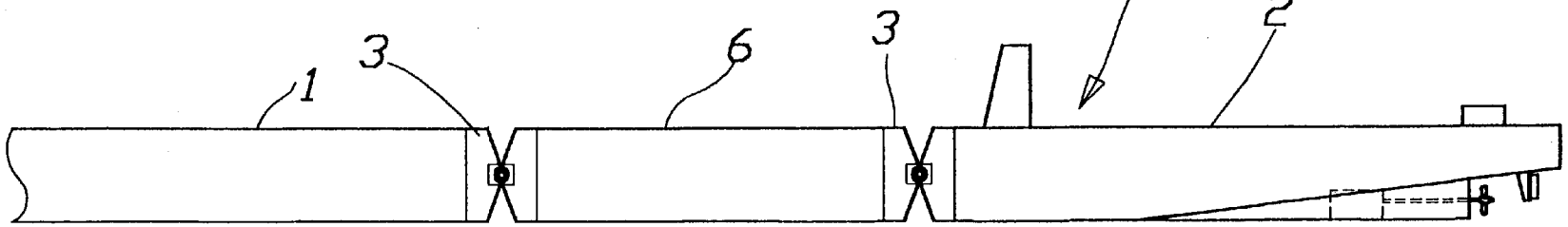
FIG. 3 is a schematic illustration of a further embodiment of the sectioned ship of the invention.

FIG. 3 reveals still another structure example of the sectioned ship of the invention, in which the sectioned ship A3 comprises a fore ship body 1, an aft ship body 2; a mid ship body 6, and two horizontal hinge means 3, for pivotally connecting the fore ship body 1 to the mid ship body and for pivotally connected the mid ship body 6 to the aft ship body 2.

Figure 4:
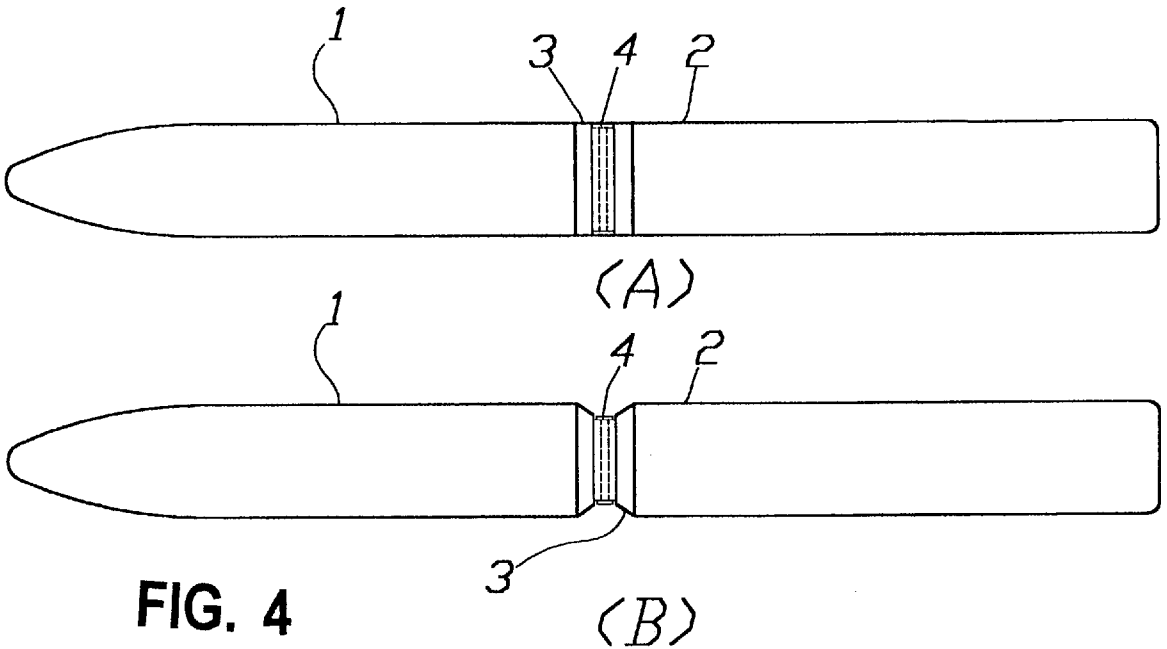
FIGS. 4(A) and 4(B) are planar schematic illustrations of two examples of setting up of the hinge means on the sectioned ship.

As shown in FIG. 4(A), the pivot shaft 4 of the horizontal hinge means 3 may pass through horizontally the bearing part of the hinge from one side of the bulwarks to the other side. It may also be that the pivot shaft 4, as shown in FIG. 4(B), is disposed between the two bulwarks of the ship and the length is shorter than ship's width. Moreover, in the case of FIGS. 1 and 2, the horizontal hinge means 3 may be welded to the fore ship body 1 and aft ship body 2 respectively However, it is to be preferred that the horizontal hinge means is releasably connected at one side to the fore ship body 1 or the aft ship body 2 by means of a plurality of bolts 10, so that on approaching a small harbor or quay, or in order to pass through a canal, if necessary, the horizontal hinge means can be loosened and disengaged, and the ship bodies separated, and then each ship body can be led into the harbor by towing boats or, say, through the Panama Canal by towing cables.

Figure 5:
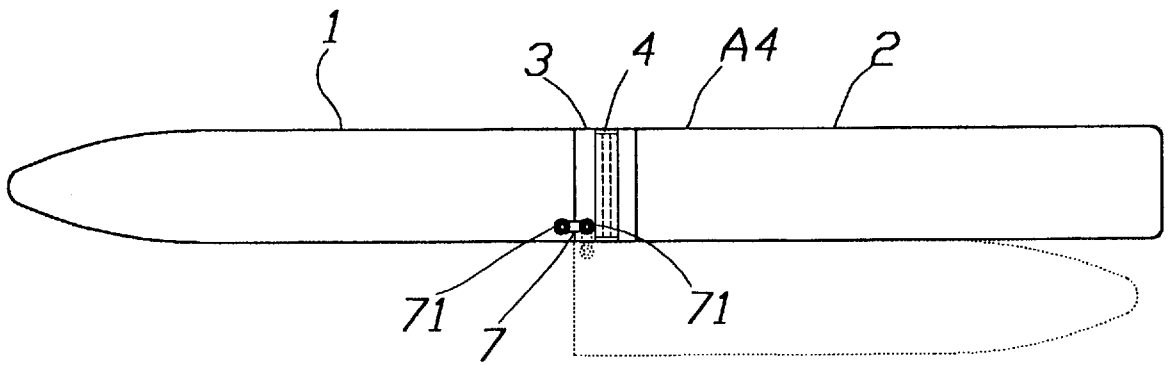
FIG. 5 is a schematic illustration of an example of the horizontally foldable structure in the fore aft ship bodies of the sectioned ship.

A special feature of the invention is that a sectioned ship A4 can be folded horizontal-wise, as shown in FIG. 5, in which the fore ship body 1 and the aft ship body 2, in addition to the vertically pivotably hinge means 3 is provided with a vertical pivot member 7 capable of pivoting horizontally on the upper deck of any side of the ship where the releasable fore ship body 1 or aft ship body 2 (in this embodiment it is the fore ship body 2) is connected to the horizontal hinge means 3. If necessary, the releasable fore ship body 1 can be separated from the hinge means 3 and thereafter, as shown by dotted lines in FIG. 5, the fore ship body 1 can be turned round 180° with pivot shaft 71 of the vertical pivot member 7 as the center by a tugboot to become side by side with the aft ship body 2 . Such folding device may facilitate loading and unloading at a small quay; it may be also of value for the sectioned ship to turn about in a small harbor or, for example, in entering the locks of the Panama Canal, since the overall length of the ship is shortened by half.

Figure 6:
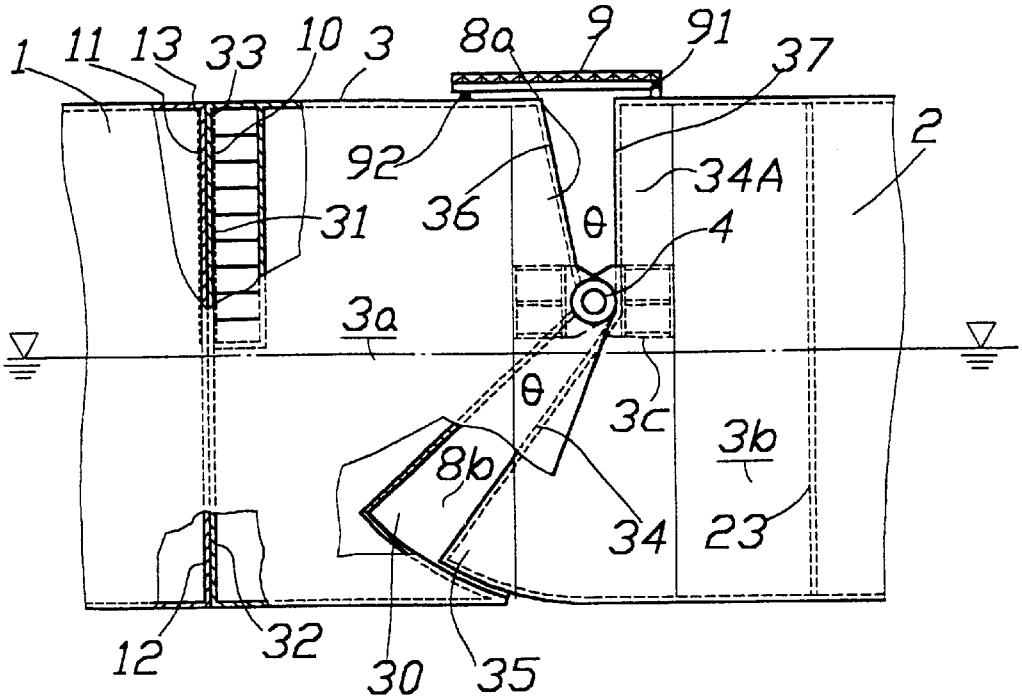
FIG. 6 is a cross-sectional view of a detailed structure example of the hinge means of the sectioned ship shown in FIG. 1.
Figure 7:
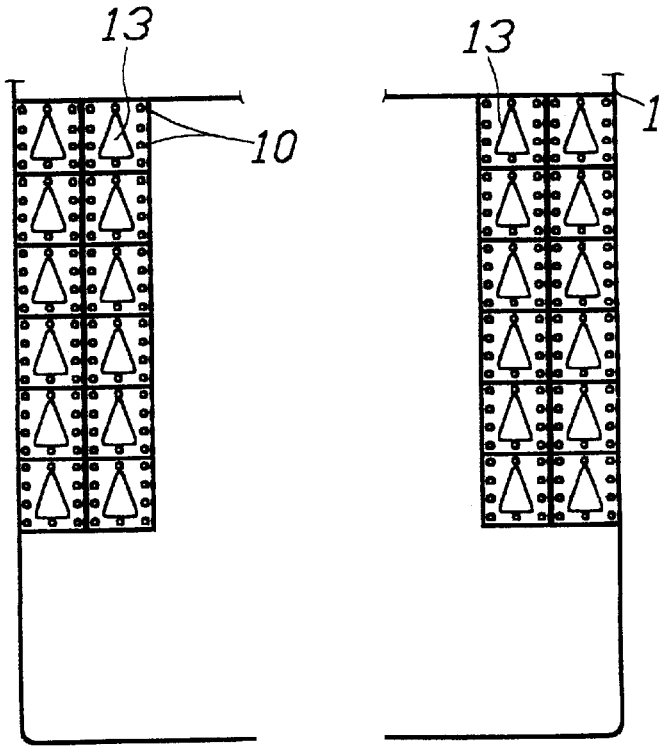
FIG. 7 is a schematic illustration of the joining part in the fore ship body of the sectioned ship shown in FIG. 1.

FIG. 6 is a detailed partial cross-sectional view of the horizontal hinge means of ship A1 already indicated in FIG. 1, wherein 1 denotes fore ship body, 2 denotes aft ship body, and 3 denotes horizontal hinge means. In this embodiment, on the upper half part of the bulwarks at the contact face between the fore ship body 1 and the horizontal hinge means 3, generally on the portion above the waterline there are formed joint parts 11, 31 for bolts 10 to pass through to be fixed is indicated tightly and be connected to each other. On the lower half part, that is, the portion below the waterline, there are formed even and smooth, closed panel faces acting as contact part 12, 32. In order to allow the fore ship body 1 and horizontal hinge means 3 to be aligned and joined together easily, as shown in FIG. 7, there are formed on the upper part of the bulwarks of the fore ship body 1 a plurality of triangular guide holes 13 , whereas on the upper part of the hinge means 3 there are formed in corresponding number as the guide holes 13 the triangular guide pins 33, whereby when the fore ship body 1 comes close to the hinge means 3 it allows by inserting guide pins 33 in the guide holes 13 each of the bolt holes to be aligned and positioned so that bolts 10 can pass through and be screwed tight.

Still referring to FIG. 6, the aft ship body 2 and horizontal hinge means 3 are welded at their contact face 23 into one inseparable body. Here the horizontal hinge means is composed of three parts, namely: a front shell part 3*a* connected by fixing tight of bolts 10 to the fore ship body 1 and forming one part of the hull, a back shell part 3*b* welded to the aft ship body 2 and forming another part of the hull, and a huge hinge body 3*c*. To enable the ship bodies to pivot up and down with respect to one another at the huge pivot shaft 4 of the hinge body 3*c* as the center under the rise and fall of waves, the upper and lower parts of the front and back shell parts 3*a* and 3*b* with pivot shaft 4 as border are provided each with a fan-shaped gap or space 8*a*, 8*b* and the included angle θ with pivot shaft 4 as the center of circle is preferably in the range between 15 and 25 degrees. Experience proves that θ of about 21° is fairly enough for front hinge part 3*a* and back hinge part 3*b* not to collide under tolerable weather condition; because, even in so difficult a situation that the ship hogs and sags violently, it is rather unlikely that either kind of deflection should exceed 20°. Since most of the lower fan-shaped space 8*b* is below the waterline, it is important to have some measure to prevent water from filling up the gap and causing resistance to the working of the horizontal hinge means. To this purpose, on the lower portion of the front shell part 3*a*, that is, the portion below the hinge body 3*c*, an inner hollow hollow 30 of a fan shape in side view is formed. To each side of the sectioned ship there is welded a fan-shaped cover plate 34 to close up the side opening of the hollow 30 so that the hollow 34 forms a pocket shaped space a. On the front lower part of the back shell part 3*b*, corresponding to the hollow 30 of the front shell part 3*a* a curve bottomed protrusion 35 is formed. When the sea is calm the protrusion 35 fills half of the hollow 30 whereby the included angle of the pivot shaft 35 between the front of the protrusion 35 and the back of the hollow 30 becomes θ, which the sagging is at the maximum 20°, said protrusion 35 will pivot with the pivot shaft 4 as the center and will enter deeper inside the hollow 30 and will not touch the hull. Also, when the sagging is of a maximum 20°, the protrusion 35 will not entirely slip off the hollow 30 and no opening will be formed at the space between the protrusion 35 and the bottom of the hollow 30.

Referring again to FIG. 6, the two opposite walls 36, 37 of the upper fan-shaped space 8*a* formed on the part of the front and back shell parts 3*a*, 3*b* above the hinge body 3*c* are formed so that when the two pivot below a determined degree of angle θ with the pivot shaft 4 as the center, the two walls will not be at a corresponding position of collision. In this embodiment, the two walls 36, 37 are formed as tilted walls, to this shape it is, however, not intended to be limited. Since the upper fan-shaped space 8*a* is usually above the water line, in this embodiment fan-shaped cover plates are therefore not formed on the two sides as is the case with the below fan-shaped space 8*b*. However, it will also do if an upper fan-shaped cover plate denoted as 34*a* by dotted lines in FIG. 6.

Figure 8:
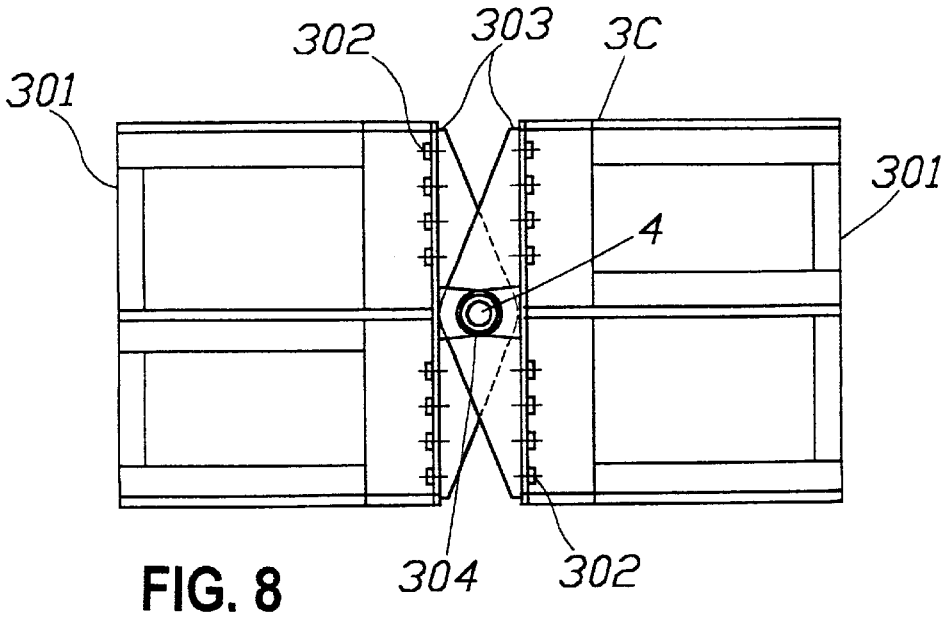
FIG. 8 is a frontal view of an embodiment of the hinge means of the sectioned

Precision and strength requirements are very high in the making and assembling of the hinge body 3*c*. In the present embodiment the hinge body 3*c* is pre-formed as a component firmly welded to joining part of the front and back shell bodies 3*a*, 3*b*. As shown in FIG. 8, the hinge body 3*c* in one embodiment comprises two left and right rectangular frames 301 made by welding of thick steel plates, a plurality of sleeve support plates 303 fixed to the left and right frames 301 and parallel arranged in a cross, staggered manner by bolts 302 and a huge frame shaft 4 passing through concentrically arranged sleeves 304 fixed by each of the support plates 303. In assembly, the hinge body 3*c* may be lifted up with a door type hoist and placed on the determined place between the front and back shell parts 3*a*, 3*b*. The two side frames 301 are welded respectively to the inside of the front and back shell parts 3*a*, 3*b* and only the sleeve support plates 303 and the pivot shaft 4 are to be exposed out in between the front and back shell parts 3*a*, 3*b*.

Thereafter, the hinge body 3*c* of the two shell parts 3*a*, 3*b* is mounted on the outside of the location and is shielded by welding with steel plates. On the deck of the front and back shell parts 3*a*, 3*b* there is mounted a bridge 9 straddling the upper fan-shaped space 8*a*. One end of the bridge 9 is pivotably connected to a pivot shaft part 91 on the back shell part 3*b* and the other end extends to the front shell part 3*a*. This other end is provided below with wheels 92, which can slide back and forth on the upper deck of the front shell part 3*a* following the change in the space of the fan-shaped space 8*a*.

Figure 9:
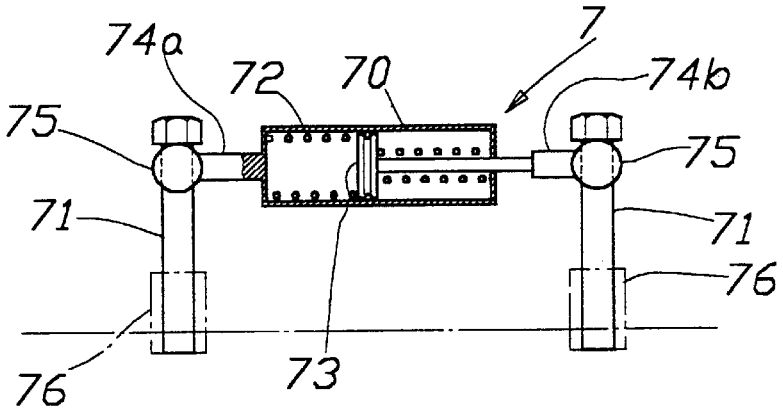
FIG. 9 is a schematic a illustration of an example of structure of the pivot part of the horizontally foldable sectioned ship shown in FIG. 5.
Figure 10:
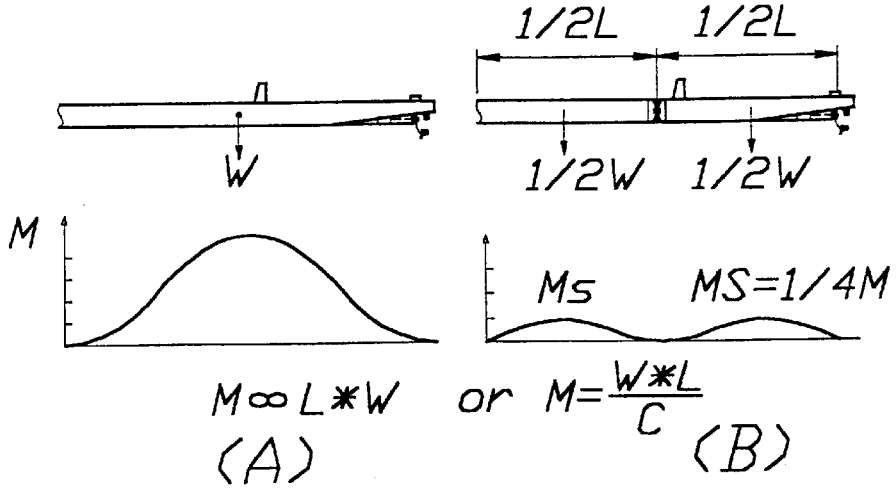
FIGS. 10(A) and 10(B) are illustrating diagrams showing the relation of the length of a sectioned ship body to the maximum bending moment.

FIG. 9 is a schematic view of the essential parts of the foldable ship body construction shown in FIG. 5, in which a vertical pivoting member 7 is located straddlingly on the upper deck close to any one side of bulwarks position between the fore ship body 1 and the hinge part 3*c*. This vertical pivoting member 7 possesses a buffer case 70 having inside a compression spring 72 and a piston 73, a rod 74*a* extended from one end of the buffer case 70, a piston rod 74*b* extended from the piston 73 toward the other end of the buffer case 70, two direction connectors 75, 75 mounted to the terminals of the two rods 74*a* and 74*b* and two vertical pivot shafts 71, 71 passing vertically through the two connectors 75 and having the lower ends fixed respectively to the support members 76 on the fore ship body 1 and the hinge body 3*c*. When the fore ship body 1 is separated from the hinge means 3 jointed to the aft ship body 2, this ship body 1 with one of the two pivot shafts 71 as the center can at once turn round 180° with respect to the aft ship body 2 or the aft ship body 2 with respect to the fore ship body 1 to be close to each other side by side as shown by dotted lines in FIG. 5.

With this novel design of sectioned ship, one can at once increase ship's hold and use less material in ship-building than what a conventional vessel of comparable dimensions will demand, if only to equal the seaworthiness of said conventional vessel.

While the invention has been particularly shown and substantially described with reference to the foregoing drawings and embodiments, it will occur to those who are skilled in the art that modifications, variations, and other changes are possible in light of the above teaching, without departing from the spirit and scope of the invention in its broader aspects; therefore, it is to be understood that, within the scope of the appended claims, the invention may be practiced otherwise than as specifically described.

What is claimed is:

1. A sectioned ship comprising ship bodies including a fore ship body and an aft ship body, and a transversally horizontal hinge block disposed between and joining together the fore ship body and the aft ship body for relative pivoting movement of the fore ship body and the aft ship body relative to each other about a horizontal transverse hinge shaft of the hinge block in a vertical direction and the hinge block, together with the fore ship body and the aft ship body, forming a ship, wherein the hinge shaft is located above a waterline of the ship, and wherein the hinge block is separably connected to at least one of the fore ship body and the aft ship body by a connecting device.

2. The sectioned ship according to claim 1, wherein the hinge block is disposed near a mid-height position of the ship bodies.

3. The sectioned ship according to claim 2, wherein the hinge block has upper and lower locations, at least one of the upper and lower locations having a fan-shaped space for pivoting movement in a vertical direction by the ship bodies.

4. The sectioned ship according to claim 2, wherein at least one fan-shaped cover plate is mounted to bulwarks on one or more sides of the ship bodies, the fan-shaped cover plate being adapted to cover a fan-shaped space of the hinge block below the waterline.

5. The sectioned ship according to claim 1, wherein the aft ship body includes a power generator and a propeller.

6. The sectioned ship according to claim 1, wherein the hinge block includes a fore hull-shaped block member, an aft hull-shaped block member, and a hinge assembly mounted between and pivotably connecting together the fore block member and the aft block member, and wherein one of the fore block member and the aft block member is separably connected to one of the fore ship body and the aft ship body and the other one of the fore block member and the aft block member is fixed to the other one of the fore ship body and the aft ship body.

7. The sectioned ship according to claim 6, wherein the hinge block has an upper fan-shaped space above the waterline between the fore block member and the aft block member and a lower fan-shaped space below the waterline between the fore block member and the aft block member.

8. The sectioned ship according to claim 6, wherein the fore block member has a v-shaped recess formed at a lower portion thereof below the hinge shaft and the aft block member has at a lower portion thereof a projecting portion that projects into the recess, and wherein a fan-shaped space is adapted to be formed between the recess and the projection.

9. The sectioned ship according to claim 8, further comprising two fan-shaped cover plates provided on sides of the fore block member for covering side openings of the fan-shaped space below the waterline.

10. A sectioned ship comprising ship bodies including a fore ship body, a mid ship body, and an aft ship body, and hinge blocks including a transversely horizontal hinge block disposed between the fore ship body and the mid ship body and a transversely horizontal hinge block disposed between the mid ship body and the aft ship body for permitting pivoting movement about horizontal transverse hinge shafts of the hinge blocks in a vertical direction of the fore ship body, the mid ship body, and the aft ship body and the hinge blocks, together with the fore ship body, the mid ship body and aft ship body, forming a ship, and wherein the hinge shafts of each of the hinge blocks are located above a waterline of the ship, and wherein at least one hinge block of the hinge blocks is separably connected to at least one of the fore ship body, the mid ship body, and the aft ship body by a connecting device.

11. The sectioned ship according to claim 10, wherein the hinge blocks are disposed near mid-height positions of the ship bodies.

12. The sectioned ship according to claims, wherein the aft ship body includes a power generator and a propeller.

13. The sectioned ship according to claim 10, wherein at least one of the hinge blocks includes a fore hull-shaped block member, an aft hull-shaped block member, and a hinge assembly mounted between and pivotably connecting together the fore block member and the aft block member, and wherein one of the fore block member and the aft block member is separably connected to one of the fore ship body, the mid ship body, and the aft ship body and the other one of the fore block member and the aft block member is fixed to an adjacent one of the fore ship body, the mid ship body, and the aft ship body.

14. The sectioned ship according to claims 13, wherein the at least one of the hinge blocks has an upper fan-shaped space above the waterline between the fore block member and the aft block member and a lower fan-shaped space below the waterline between the fore block member and the aft block member.

15. The sectioned ship according to claim 13, wherein the fore block member has a v-shaped recess formed at a lower portion thereof below the hinge shaft and the aft block member has at a lower portion thereof a projecting portion that projects into the recess, and wherein a fan-shaped space is adapted to be formed between the recess and the projection.

16. The sectioned ship according to claim 15, further comprising two fan-shaped cover plates provided on sides of the fore block member for covering side openings of the fan-shaped space below the waterline.

17. A sectioned ship comprising ship bodies including a fore ship body and an aft ship body, and a transversally horizontal hinge disposed between and joining together the fore ship body and the aft ship body, the hinge being adapted to permit limited pivoting movement of the fore ship body and the aft ship body relative to each other in a vertical direction and, together with the fore ship body and the aft ship body, forming a ship, and a vertical pivoting member between the fore ship body and the aft ship body, the vertical pivoting member permitting the fore ship body and the aft ship body to pivot horizontally relative to each other after separating the fore ship body and the aft ship body at the hinge.

18. The sectioned ship according to claim 17, wherein the hinge is disposed at a bottom position of the ship bodies and has a horizontal pivot shaft located below a waterline of the ship.

19. The sectioned ship according to claim 2, wherein the hinge block has an upper location with a fan-shaped space for pivoting movement in a vertical direction by the ship bodies.

20. A sectioned ship comprising ship bodies including a fore ship body, a mid ship body, and an aft ship body, and hinges including a transversely horizontal hinge disposed between the fore ship body and the mid ship body and a transversely horizontal hinge disposed between the mid ship body and the aft ship body, the hinges joining together and permitting limited pivoting movement in a vertical direction of the fore ship body, the mid ship body, and the aft ship body and, together with the fore ship body, the mid ship body, and the aft ship body, forming a ship, and a vertical pivoting member between at least one of the fore ship body and mid ship body and the mid ship body and the aft ship body, the vertical pivoting member permitting the at least one of the fore ship body and the mid ship body and the mid ship body and the aft ship body to pivot horizontally relative to each other after separating the at least one of the fore ship body and the mid ship body and the mid ship body and the aft ship body at the hinge.

21. The sectioned ship according to claim 20, wherein the hinges are disposed at a bottom position of the ship bodies and each has a horizontal pivot shaft located below a waterline of the ship.

22. The sectioned ship according to claim 21, wherein the hinge blocks each have upper and lower locations, at least one of the upper and lower locations having a fan-shaped space for pivoting movement in a vertical direction by the ship bodies.

23. The sectioned ship according to claim 22, wherein the hinge blocks each have an upper location with a fan-shaped space for pivoting movement in a vertical direction by the ship bodies.

24. The sectioned ship according to claim 21, wherein at least one fan-shaped cover plate is mounted to bulwarks on one or more sides of the ship bodies, the fan-shaped cover plate being adapted to cover a fan-shaped space of at least one of the hinge blocks below the waterline.

* * * * *